US011027568B2

(12) United States Patent
Zarley

(10) Patent No.: US 11,027,568 B2
(45) Date of Patent: Jun. 8, 2021

(54) SELF-SUPPORTING BOOK

(71) Applicant: Kermit Zarley Enterprises, Scottsdale, AZ (US)

(72) Inventor: Kermit Zarley, Scottsdale, AZ (US)

(73) Assignee: Kermit Zarley Enterprises, Scottsdale, AZ (US)

( * ) Notice: Subject to any disclaimer, the term of this patent is extended or adjusted under 35 U.S.C. 154(b) by 0 days.

(21) Appl. No.: 16/901,895

(22) Filed: Jun. 15, 2020

(65) Prior Publication Data

US 2020/0307298 A1 Oct. 1, 2020

Related U.S. Application Data

(63) Continuation-in-part of application No. 16/244,246, filed on Jan. 10, 2019, now Pat. No. 10,682,876,
(Continued)

(51) Int. Cl.
*B42D 3/12* (2006.01)
*B42D 3/06* (2006.01)
(Continued)

(52) U.S. Cl.
CPC ..... *B42D 3/126* (2013.01); *B42B 5/08* (2013.01); *B42D 3/06* (2013.01); *B42D 1/004* (2013.01);
(Continued)

(58) Field of Classification Search
CPC ..... B42D 3/126; B42D 3/06; B42D 1/004; B42B 5/08; B42P 2241/12; B42P 2241/02
(Continued)

(56) References Cited

U.S. PATENT DOCUMENTS 1,577,697 A 2/1926 Douglas
2,229,012 A 1/1941 Geyzer
(Continued)

FOREIGN PATENT DOCUMENTS

FR 2688395 A1 9/1993
GB 262274 A 12/1926

OTHER PUBLICATIONS wwwshoplet.com; Flip-N-Tell Display Easel Books; Apr. 29, 2009; pp. 1-2.

(Continued)

*Primary Examiner* — Justin V Lewis
(74) *Attorney, Agent, or Firm* — Invention To Patent Services; Alex Hobson

(57) ABSTRACT

A book has a front cover having a first edge which is unconnected, and an opposing second edge which is connected to a spine. A back cover has a first edge which is connected to the spine and an opposing second edge which is connected to flexible joint or fold-line. The book has a third cover having a first edge which is connected to the flexible joint, that couples the third cover to the back cover, and an opposing second edge which is connected to binding. The front cover is configured to fold back about the spine to retain the third cover proximal the outer edge of the third cover to retain the book in a propped-up position for reading. A page holder slides along the left and right sides of the third cover and has an opening that allows a page to be pushed therethrough.

17 Claims, 13 Drawing Sheets

Related U.S. Application Data which is a continuation-in-part of application No. PCT/US2017/060718, filed on Nov. 8, 2017, which is a continuation-in-part of application No. 15/348,505, filed on Nov. 10, 2016, now Pat. No. 9,895,920, which is a continuation-in-part of application No. 13/934,298, filed on Jul. 3, 2013, now abandoned, which is a continuation-in-part of application No. 12/862,208, filed on Aug. 24, 2010, now Pat. No. 8,485,557, which is a continuation-in-part of application No. 12/548,825, filed on Aug. 27, 2009, now abandoned.

(60) Provisional application No. 61/263,133, filed on Nov. 20, 2009.

(51) Int. Cl.

| | |
|---|---|
| ***B42B 5/08*** | (2006.01) |
| ***B42D 1/00*** | (2006.01) |
| ***B42B 5/10*** | (2006.01) |
| ***B42D 3/10*** | (2006.01) |

(52) U.S. Cl.
CPC ..... *B42P 2241/02* (2013.01); *B42P 2241/12* (2013.01)

(58) Field of Classification Search
USPC ..... 281/3.1, 15.1, 33, 44, 45; 283/63.1, 64
See application file for complete search history.

(56) References Cited

U.S. PATENT DOCUMENTS

| | | | | |
|---|---|---|---|---|
| 2,258,282 | A | 10/1941 | Ericson | |
| 2,613,956 | A | 10/1952 | Ericson | |
| 2,617,665 | A | 11/1952 | Ericson | |
| 3,041,637 | A | 7/1962 | Emery | |
| 3,270,449 | A | 9/1966 | Robbie | |
| 3,620,552 | A * | 11/1971 | Woodcock | B42D 1/001 281/33 |
| 3,945,598 | A | 3/1976 | Bell | |
| 4,058,327 | A | 11/1977 | Sulivan et al. | |
| 4,240,761 | A | 12/1980 | Jacobson | |
| 4,880,327 | A | 11/1989 | Sanabria | |
| 5,230,535 | A | 7/1993 | Figlenski | |
| 5,586,786 | A | 12/1996 | Su | |
| 6,749,228 | B2 | 6/2004 | Takemura | |
| 2005/0001420 | A1 | 1/2005 | Gordon | |

OTHER PUBLICATIONS www.rapidsupplies.com; Lion 39008 Flip-N-Tell Horizontal Ease, 11"×8-1/2", Black, LIO398008, LIO 398008, Apr. 29, 2009; pp. 1-2.
Crane Binder Technologies; www.cranebinder.com; 11×17 Turned Edge 3 Ring Binder, Apr. 29, 2009, page 1.
Crane Binder Technologies, www.cranebinder.com; Aluminum Easel Binders; p. 1-2.

* cited by examiner

SELF-SUPPORTING BOOK

CROSS REFERENCE TO RELATED APPLICATIONS

This application is a continuation-in-part of U.S. patent application Ser. No. 16/244,246, filed on Jan. 10, 2019, which is a continuation in part of PCT application no. US2017/060718 filed on Nov. 8, 2017, which is a continuation-in-part of U.S. patent application Ser. No. 15/348,505, filed on Nov. 10, 2016 and now issued as U.S. Pat. No. 9,895,920 on Feb. 20, 2018, which is a continuation in part of Ser. No. 13/934,298 filed Jul. 3, 2013, which is a continuation-in-part of U.S. patent application Ser. No. 12/862,208 filed Aug. 24, 2010 and now issued as U.S. Pat. No. 8,485,557 on Jul. 16, 2013, which is a continuation-in-part of U.S. patent application Ser. No. 12/548,825 filed Aug. 27, 2009, and U.S. patent application Ser. No. 12/862,208 claims the benefit of U.S. provisional application No. 61/263,133 filed Nov. 20, 2009; the entirety of each are hereby incorporated by reference.

BACKGROUND OF THE INVENTION

Field of the Invention

The invention relates to self-supporting books and a self-supporting book stand for receiving a detachably attachable book.

Background

This invention relates to a book. More specifically, and without limitation, this invention relates to a self-supporting books and book stands for supporting a page of a book.

Traditional books are well known in the art and generally comprise a plurality of pages positioned between a front cover and a back cover which are connected by way of a binding therebetween. These books are convenient for reading and studying when held in a reader's hands or placed in their lap, but are difficult to hold open when placed on a flat surface due to the bindings. More specifically, these books often have stiff bindings which involuntarily change pages or close the book altogether if a user's hand or other object is not present on the book to hold the book open.

To address these issues various designs were introduced to prop the book up. In particular, one design had a folding member which folded under the book perpendicular to the binding. Although this arrangement propped the book up, the folding member weakened the cover and the binding. Additionally, this arrangement lacked the necessary structural rigidity to support the book in a sturdy manner.

Additional designs have mating tabs with opposing hook & loop portions allowing the user to prop the book up at various angles. This design also has deficiencies as the connection does not provide sufficient structural rigidity. Also, the hook and eye arrangement has a tendency to interfere with the user's clothing.

Therefore, a need exists in the art for a book that addresses these deficiencies.

Thus, an object of the present invention is to provide a book that is capable of being propped up in a secure manner.

Another object of the present invention is to provide a cover arrangement which allows a user to easily display the pages of the book.

Yet another object of the present invention is to provide a hands-free book that, when opened, is capable of being propped up in a secure manner with lay-flat pages.

These and other objects, features, or advantages of the present invention will become apparent from the specification and claims.

SUMMARY OF THE INVENTION

A book has a front cover having a first edge which is unconnected, and an opposing second edge which is connected to a spine that wraps around the book's binding. A back cover has a first edge which is connected to the spine and an opposing second edge which is connected to flexible joint or fold-line. The book has a third cover having a first edge which is connected to a flexible joint and an opposing second edge which is connected to binding which contains pages and a stabilizing sheet.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
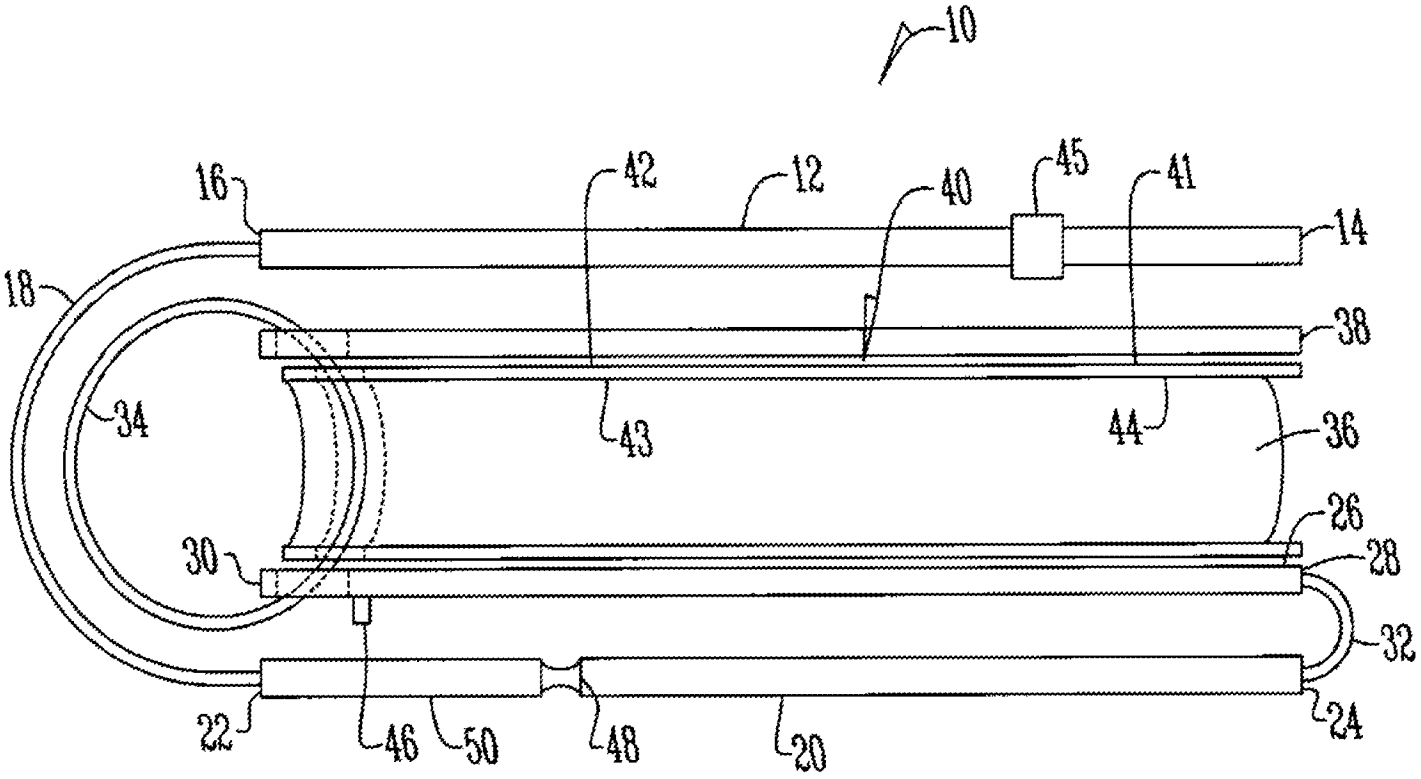
FIG. 1 is an elevational view of an exemplary self-supporting book in a closed position.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

Traditional book measures longer from top to bottom, called its "height," than it does from side to side, called its "width." All embodiments described herein present a book in which the book's binding and spine extend the height of the book, on one side or the other; yet the indicia on the pages of these embodiments is disclosed as being in the horizontal (landscape) position so that the book is propped in the horizontal position as well. This arrangement not only provides a long spine for viewing on the bookshelf, but also the horizontal propped position is most stable. However, all such embodiments described herein can accommodate the binding and spine being placed along the width of the book instead of its height, wherein such a book would have its binding at the top and open from the top, its indicia would be oriented on the pages would be placed as in a traditional book, and such a book would be propped in the vertical position.

Figure 2:
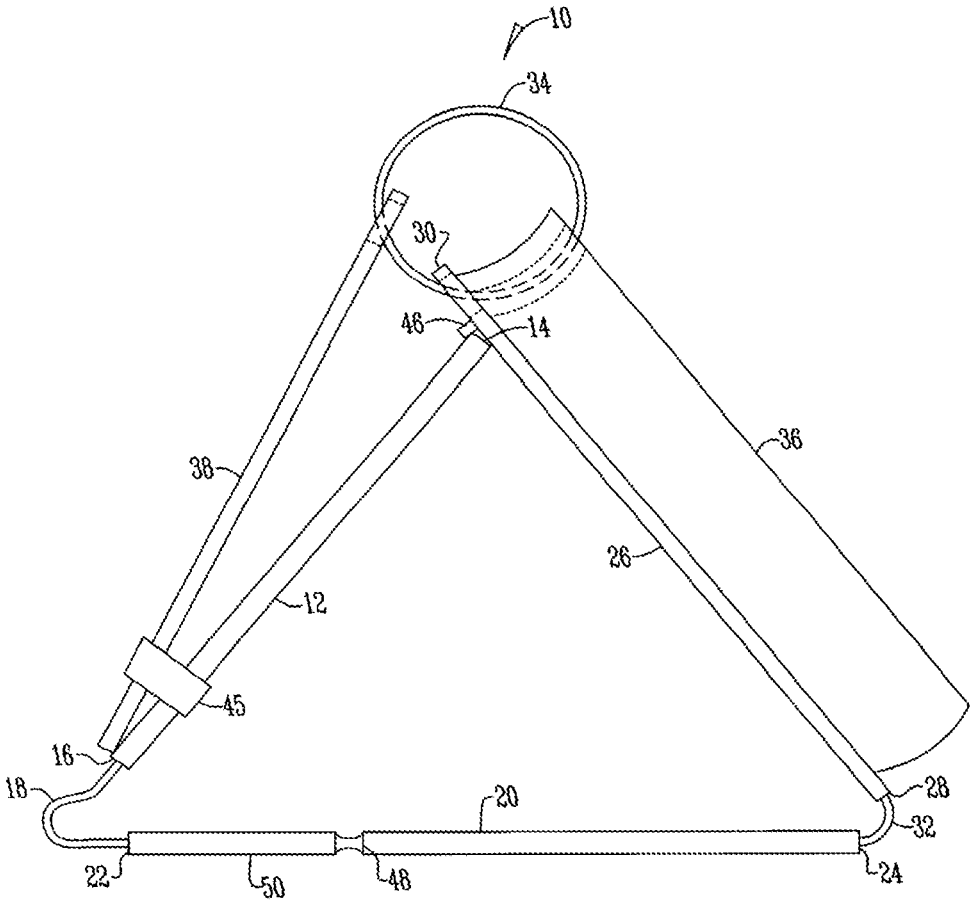
FIG. 2 is an elevational view of an exemplary self-supporting book in a propped-up position.
Figure 3:
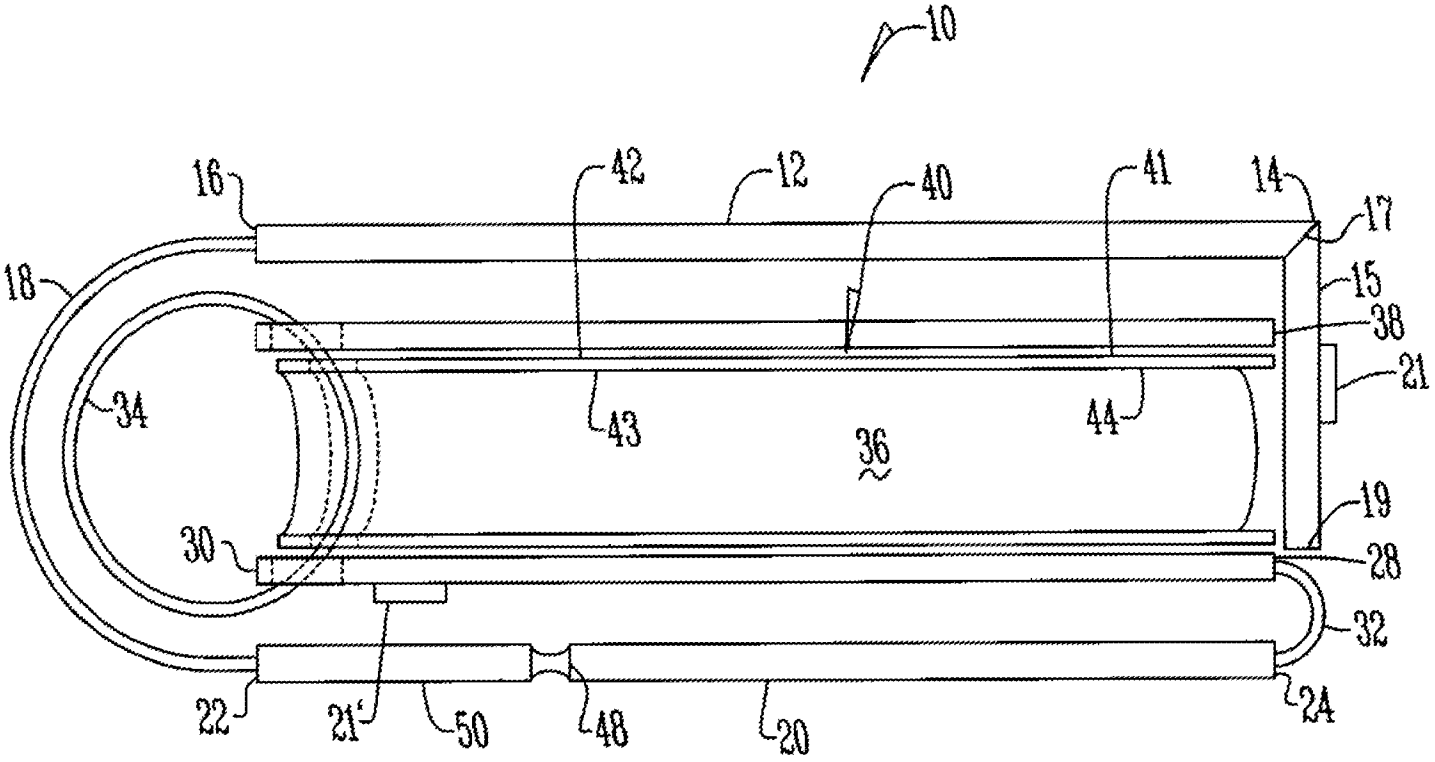
FIG. 3 is an elevational view of an exemplary self-supporting book in a closed position.

Referring to FIGS. 1 and 2, a book 10 has a front cover 12 with a first outer edge 14 and a second inner edge 16. The inner edge 16 of the front cover 12 is connected to a spine 18. A back cover 20 has an inner edge 22 and an outer edge 24 and is connected to the spine 18 along the inner edge 22.

A third cover 26 has a first and second edge, an inner edge 28 and an outer edge 30, respectively. The first inner edge 28 of the third cover 26 is connected to the outer edge 24 of the back cover 20 along fold-line 32 by any conventional manner. The inner edge 22 of the back cover is coupled with the inner edge 16 of the first front cover 12 along the spine 18.

Connected to the outer edge 30 of the third cover 26 is a binding 34. The binding 34 is of any type such as a spiral, comb, rings, twin wire, double loop, or the like. Preferably, the binding is an o-wire. Attached to the binding is a plurality of pages 36 and a stabilizing sheet 38. The stabilizing sheet 38 preferably made of plastic and generally is the same size as the pages and is positioned on top of the pages 36 and away from the third cover 26. Preferably, stabilizing sheet is thicker, denser and heavier than a page 36 so as to provide the necessary strength, weight and support.

The pages 36 contain printed indicia 40. While the indicia is printed in any format, preferred is that the indicia be printed two column, double sided on a horizontal plane such that pages one, two, three, and four follow the order shown in the Figures by reference numerals 41, 42, 43 and 44 respectively.

In a closed position, the third cover 26 sits on top of the back cover 20 and the pages 36 and stabilizing sheet 38 are positioned between the front cover 12 and the third cover 26. In this position the spine wraps around the book's binding, connecting it but not connected to it. To move to a propped position, the front cover 12 is folded outwardly along the spine away from the stabilizing sheet 38 and the third cover 26 is folded outwardly away from the back cover 20. Once folded outwardly, the outer edge 14 of the front cover 12 is moved inwardly and the outer edge 30 and binding 34 of the third cover 26 are moved inwardly such that the outer edge 14 of the front cover 12 engages the outer edge 30 and binding 34 of the third cover 26 in a supporting manner to form a triangle between the front cover 12, the back cover 20, and the third cover 26. Once positioned, the stabilizing sheet 38 is flipped so as to engage the outer surface of the front cover 12. The stabilizing sheet 38, which extends down the outer surface of the front cover 12, provides support that prevents the outer edge 14 of the front cover 12 from sliding up over the third cover 26 and over the binding 34 causing the triangle formation to collapse. To fully stabilize the book's propped position (built-in bookstand) in a preferred embodiment, so that it cannot collapse, an elastic member 45 that preferably is a rubber band is placed around the front cover 12 and stabilizing or plastic sheet 38 so that they remain unified. In an alternative embodiment, a hook-and-loop is utilized on the front cover and stabilizing sheet to connect the two together. The width of the spine 18 affects the angle of the propped position and the ease of reading. Thus, preferred is that the width of the spine 18 be greater than the width of fold-line 32.

Additionally, the third cover 26 has a stop 46 that is positioned on the surface of the third cover 26 away from the pages 36 such that the outer edge 14 of the front cover 12 engages the stop 46 in a propped position. The stop 46 is a groove or projection formed to engage edge 14. A stop may be configured above and below the first outer edge 14 of the front cover 12 and extend across the back face of the third cover. The first out edge 14 of the front cover may be secured between an upper and lower stop to secure the book in a propped-up configuration.

The book 10 can also be read without using its built-in bookstand. This is made possible by adding an extra joint 48 on the back cover 20 of a preferred embodiment. The extra joint 48 allows the front cover 12, spine 18, and small portion of the back cover 50 to fold inward at this extra joint 48 until all of the three book covers 12, 20, 26 lie against each other, with the front cover 12 extending a few inches beyond the other two covers 20, 26.

The book 10 is then placed on a flat surface so that the pages 36 and stabilizing sheet 38 can be rotated 180 degrees over the wire binding 34 to lie apart from the covers 12, 30, 26. The stabilizing sheet 38 is rotated 180 degrees back again until it lies flat against the covers 12, 20, 26. The elastic member or rubber band 45, is then placed around the three book covers 12, 20, 26 and the plastic sheet 38, unifying them together. The book's pages 36 are then rotated 180 degrees so that they lie against these unified components 12, 20, 26, 38. The book 10 is now ready to read in its non-propped position. With the reader in a sitting position, she/he can hold the book's sides with both hands, with the bottom of the front cover 12 resting against the reader's thighs, the book's sides with both hands, with the bottom of the front cover 12 resting against the reader's thighs, hips, or belly. Hands can be freed by also resting the back of the book against the edge of a table or desk.

In another embodiment, the outer edge 14 of the front cover 12 includes an extension 15 which extends perpendicularly downwardly from the outer edge 14 of the front cover 12 at a 90 degree angle in the book's 10 closed position by a fold line 17. In the book's 10 closed position, the extension 15 is adjacent to the outer edges of the book's pages 36 on the edges of the pages opposite the binding 34 and spine 18, hiding the pages from view wherein the end 19 of the extension 15 is adjacent to and touches the inner edge 28 of the third cover 26. The width of the extension 15 may be chosen to cover the total thickness and number of pages 36 included in the book 10. The angle defined by the front cover 12 and the extension 15 does not exceed 90 degrees; however, in a preferred embodiment the angle of the extension 15 flexes inwardly by 20-30 degrees toward the front cover 12 to permit a flush attachment between the extension 15 and the third cover 26 when the book 10 is in a propped-up configuration.

In a preferred embodiment, an attachment 21, such as a hook-and-loop fastener attachment is attached to the outer surface of the extension 15, and at least one complimentary hook-and-loop fastener attachment 21' is secured to the back of the third cover 26 adjacent to and just below where the third cover connects to the binding 34. Proximal the outer edge of the third cover, or proximal to the binding, as used herein, means closer to the outer edge 30 than the inner edge 28 of the third cover. Alternatively, the attachment 21, includes, but it not limited to, any type of fastener element such as magnetic material, including at least one magnet, a stop, or plurality of stops, a tab or post and slot arrangement and the like. A post or protrusion may extend from one of the back of the third cover or the front cover, or extension therefrom, and a slot to receive the post, such as a slot or indented receiver of a cleat may extend around the post to secure the self-supporting book in a propped-up configuration. A cleat may be similar to a wall hanging cleat that is attached to a frame having an indent or sawtooth pattern along the bottom configured to rest on a nail or screw in a wall. The attachment on the front cover may be configured on the front cover, such as proximal to or extending from the outer edge, or may be configured on the extension, as described herein. An attachment means, as used herein includes any of the attachments as described herein including hook-and-loop fastener, a magnet detachably attached to a magnetic material, a stop or plurality of stops, a protrusion and a slot or aperture such as in one of the covers or configured on a cleat attached to a cover.

In a preferred embodiment, two or more complimentary hook-and-loop fastener attachments 21 are attached to the outer surface of the extension 15 and the back of the third cover 26. The attachments may be discrete attachments, such as being located separately along the extension and back of the third cover to enable easy detachment for reconfiguring the book in a closed configuration. A discrete attachment may be circular or polygonal in shape for example. Two or more discrete attachments may be configured along the extension or the back of the third cover. Also, an attachment may be strip, such as a strip of hook-and-loop fastener or a strip of a magnetic material. A strip may extend horizontally across the back of the third cover and/or along the front cover.

In another preferred embodiment, the attachment comprises magnetic material, such as a magnet or a material that is attracted to a magnet, such as steel. One or both of the attachments may be a magnet such that the attachment proximal to the first outer edge of the front cover is attracted to the magnetic material attachment 21' on the back of the third cover 26. When both the attachments are magnets, they would be arranged to attract each other, with one have an exposed south pole face and the other having an exposed north pole face. The attachment on the front cover may be proximal to the first outer edge of the front cover or configured on an extension of the front cover.

In order for a user to prop the closed book 10 up, the user lifts the front cover 12, and while holding the front cover 12 erect, the third cover 26 with the pages 36 lying upon the third cover 26 is lifted. The third cover 26 and front cover 12 are moved toward each and the third cover 26 to be placed upon the extension 15 of the erect front cover 12 such that the hook-and-loop attachments 21 of the extension 15 mate with and adhere to the complimentary hook and loop attachments 21 placed on the outside surface of the third cover 26. The propped book 10 is now ready to read.

In another embodiment, the front cover 12 has a strip or flap 52 near the first outer edge 14 which is defined by fold-line 54. Preferably, attached to the top of the strip are fasteners 21 that are positioned to align with fasteners 21 on the third cover 26 when the book 10 is in a propped position.

To move a closed book 10 to a propped position, the front cover 12 is lifted and the strip 52 is pushed downwardly along fold-line 54. The front cover 12 and strip 52 are then folded over such that the fasteners 21 on the strip 52 align with and engage the fasteners 21 on the third cover 26.

For use with the propped book 10, provided is a removable page holder 56. The page holder 56 has a top bar 58, and a bottom bar 60 that are spaced apart and connected at their ends by a pair of side members 62 and 64. Preferably the side members 62 and 64 have U-shaped channels that are formed to frictionally and slidably engage the edges of the third cover 26 or any other cover of the book.

In operation, the edges of the cover 26 are received within the channels of the U-shaped sides 62 and 64 and the page holder 56 is slid along the cover such that top bar 58 and bottom bar 60 are near or engage the cover 26. In a propped position, the page holder 56 is slid such that the top bar 58 extends beyond the edge of the cover 26 while the bottom bar 60 remains adjacent the cover 26. In this position a page 36 may be raised to rest against the top bar 58 and or side members 62 and 64 so that the page may be read. A page 36 resting against the top bar 58 can easily be pushed through the cavity of the page holder 56 so that page 36 falls to the other side of the propped book to rest against the front cover 12. All such rotated pages 36 can be pushed back through the cavity 59 of the page holder 56 to lie as against the front cover 12. The page holder 56 can then be pushed down to remain attached to the third cover 26. The book can then be closed with the page holder 56 still attached inside.

Figure 5:
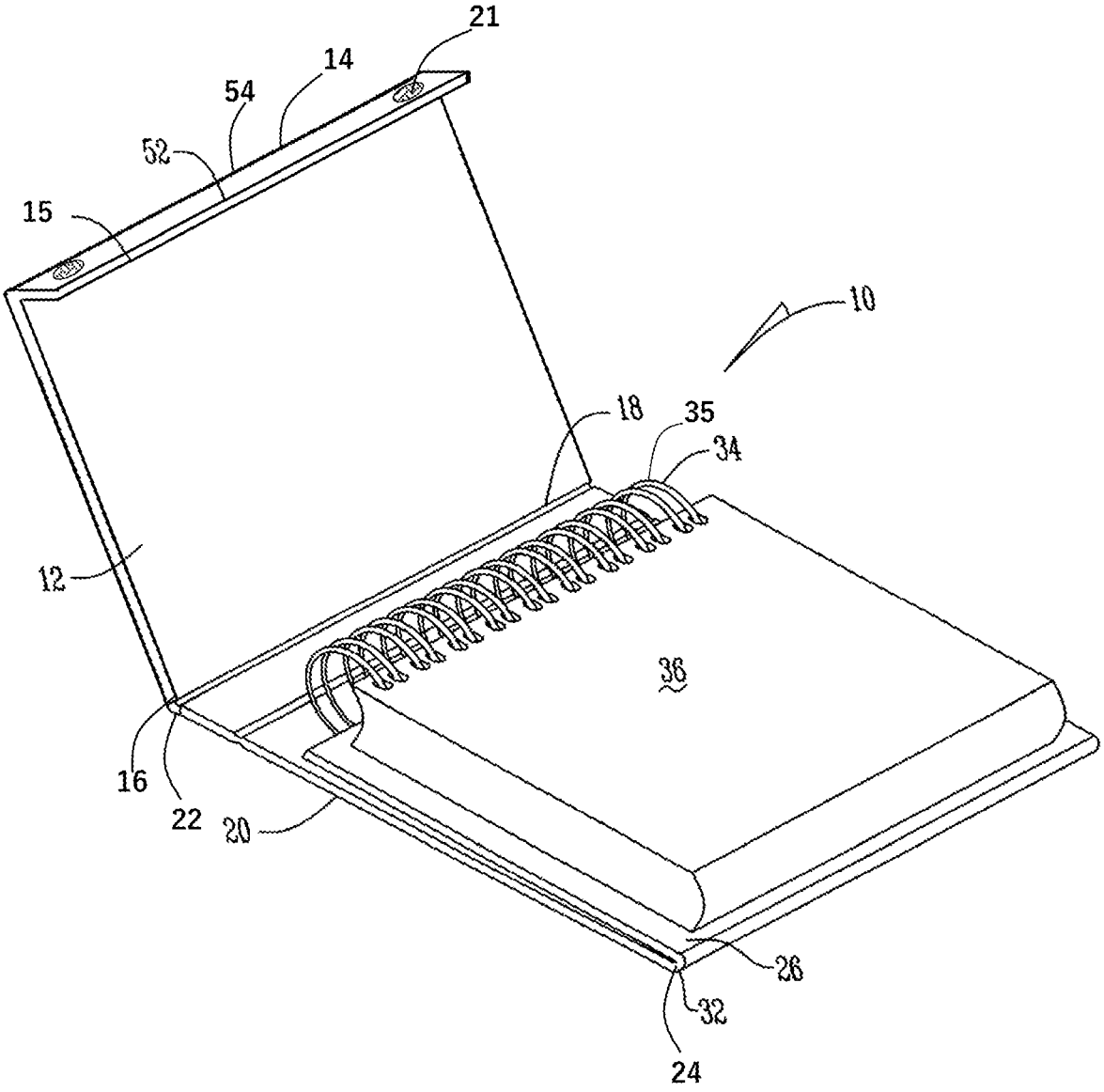
FIG. 5 is a perspective view of an exemplary self-supporting book in an open position with the front cover rotated up having a supporting strip extension from the extended end, or first outer edge of the front cover.

As shown in FIG. 5, an exemplary self-supporting book 10 is in an open position with the front cover 12 rotated open about the inner edge 16. The front cover has a extension 15 that extends from the first outer edge 14 of the front cover. The extension strip 52 has hook-and-loop fasteners 21 for engaging with hook-and-loop fasteners on the back side of the third cover 26 to support the book in a propped up and reading orientation.

Figure 6:
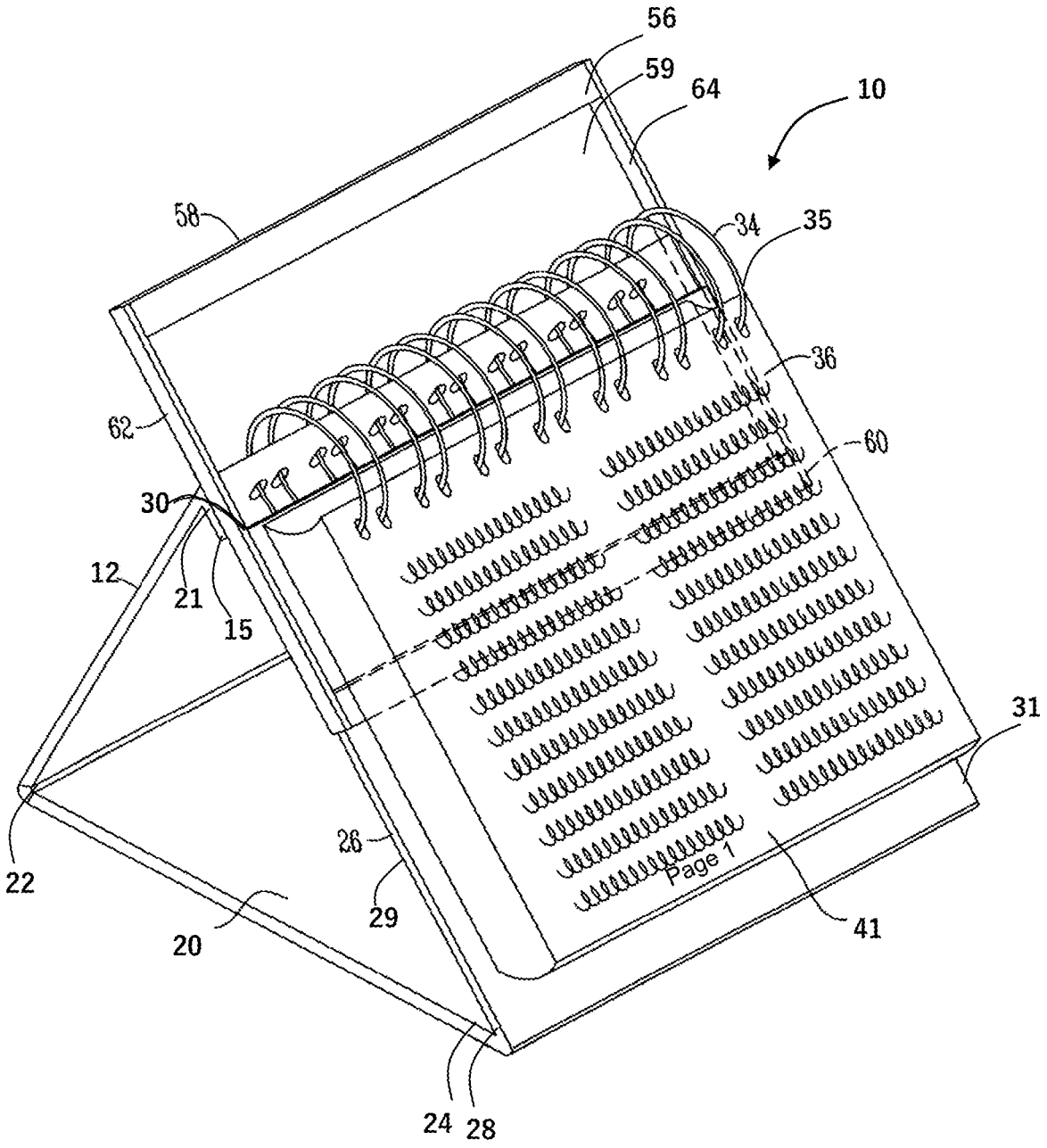
FIG. 6 is a perspective view of an exemplary self-supporting book in a propped position with a page holder.

As shown in FIG. 6, an exemplary self-supporting book 10 is in a propped position with a page holder 56 partially slid up along the third cover 26. The left side member 62 of the page holder comprises a channel that extends over the left side edge 29 of the third cover and a bottom bar 60 extends to the right side member 64 to provide stability for the page holder. The bottom bar may extend across the back-side of the third cover, the front-side of the third cover or both. In a preferred embodiment, the bottom bar extends only along the back-side of the third cover as it would not be sliding against the pages of the book on the front-side. The right side member 64 comprises a channel that extend around the right side edge 31 of the third cover. The page holder is configured to slide up and down to support a page 36. The back cover 20 is resting on a surface and the front cover 12 is supporting the third cover in a propped-up reading orientation. The supporting extension 15 from the front cover is supporting the third cover and hook-and-loop fasteners 21 configured on both the extension 15 and the back side of the third cover retain the book in a propped-up orientation.

Figure 7:
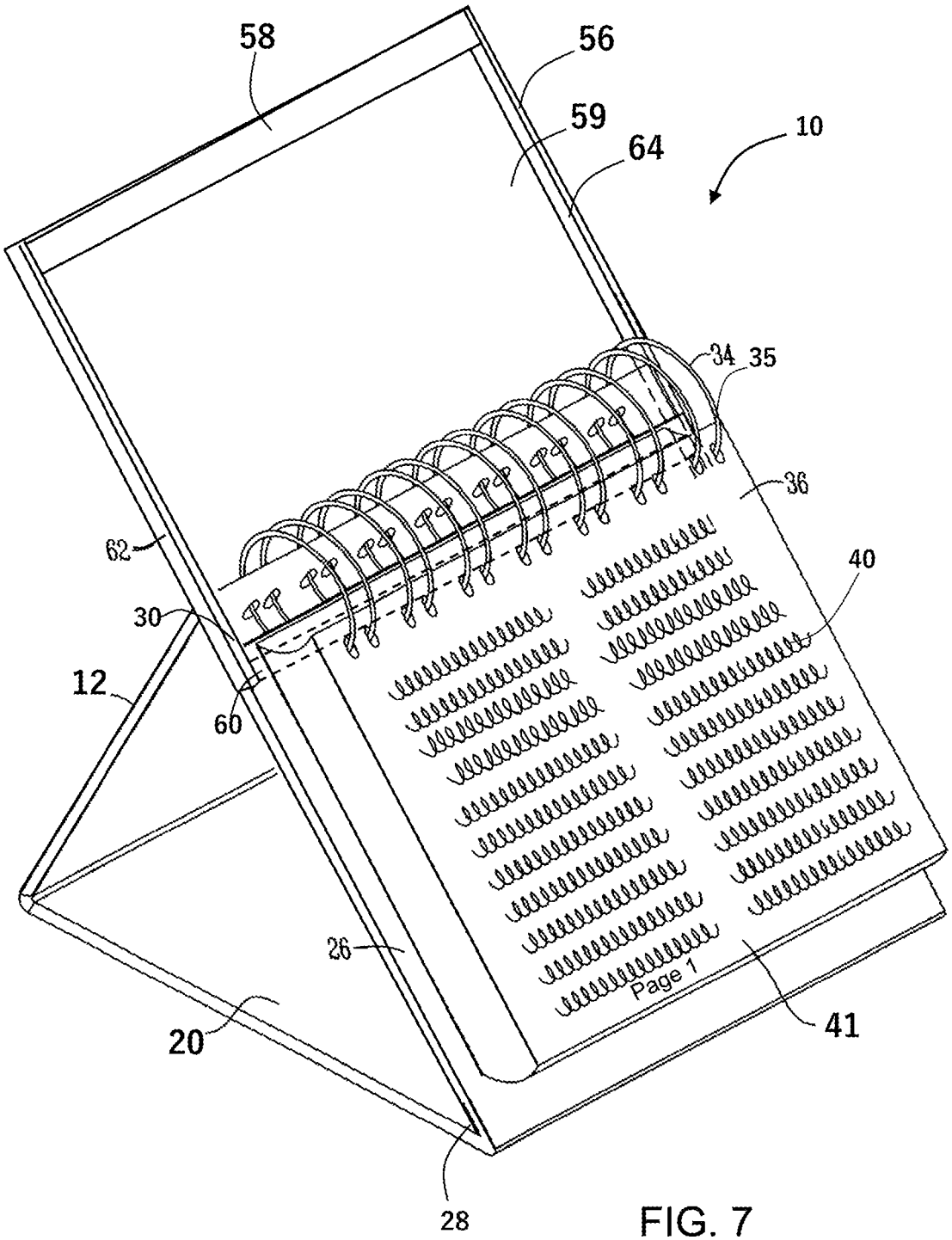
FIG. 7 is a perspective view of an exemplary self-supporting book in a propped position with a page holder slid up to a page supporting orientation.

As shown in FIG. 7, an exemplary self-supporting book 10 is in a propped position with the page holder 56 slid up to a page supporting orientation. The page holder can support a page along the top bar 58 and/or along the left or right side members, 62, 64 respectively. A page 36 can be pushed through the cavity 59 of the page holder, or the open area between the left side member 62 and right side members 64 and between the top bar 58 and the binding 34 of the book.

Figure 8:
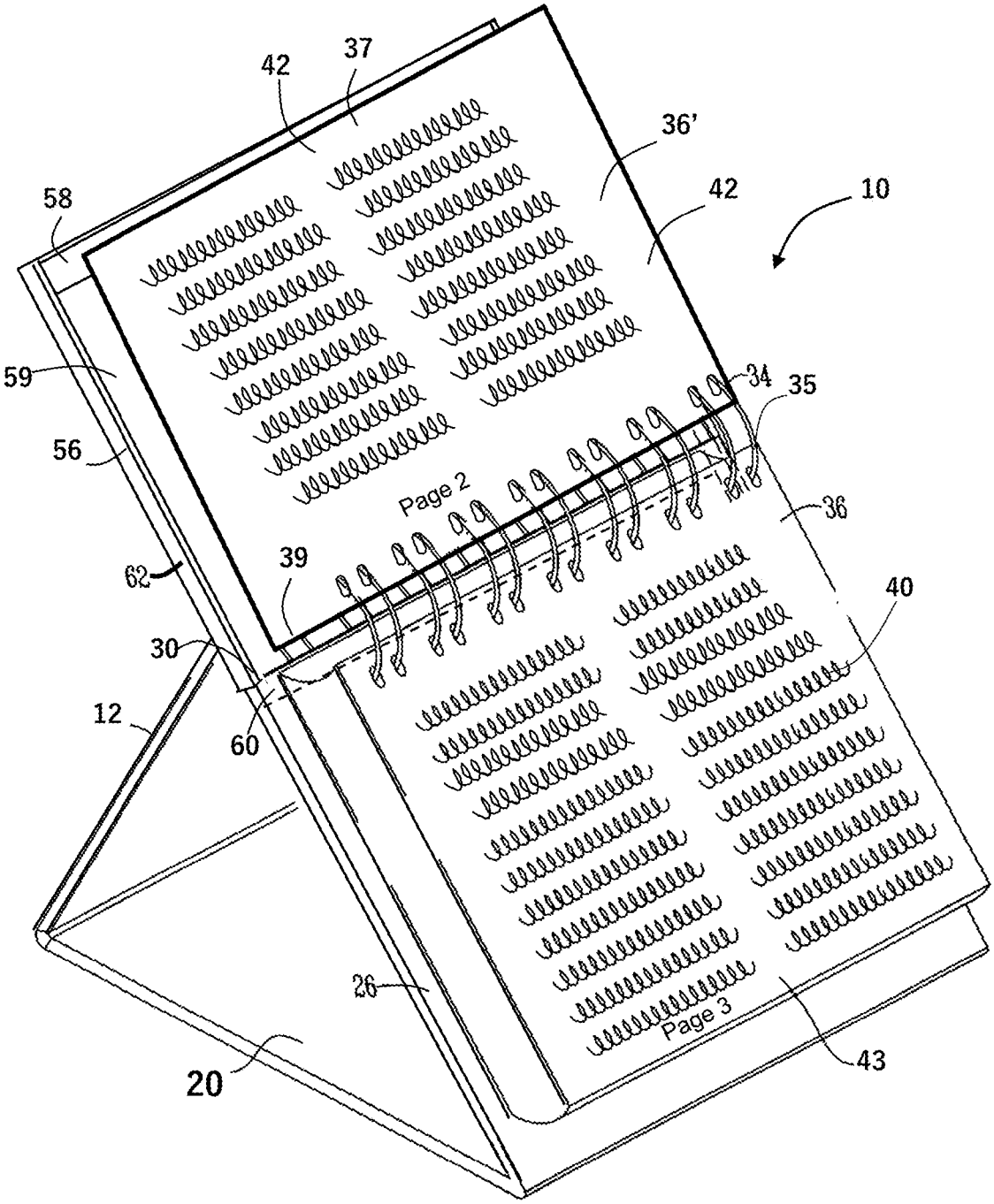
FIG. 8 is a perspective view of an exemplary self-supporting book in a propped position with a page holder supporting a page.

As shown in FIG. 8, an exemplary self-supporting book 10 is in a propped position with a page holder 56 supporting a page 36 of the book in a page supporting orientation. The page holder extends from the outer edge 30 of the third cover. The extended end 37 of the first page 36' of the book is being supported along the top bar 58 of the page holder 56. The attached end of the page 39 is retained by the binding, a plurality of rings that extend through apertures in the pages. The back side of the first page, or page 2, 42 is exposed for the reader to read. The third page 43 is exposed below the second page to allow for easy reading of multiple pages at one time.

Figure 9:
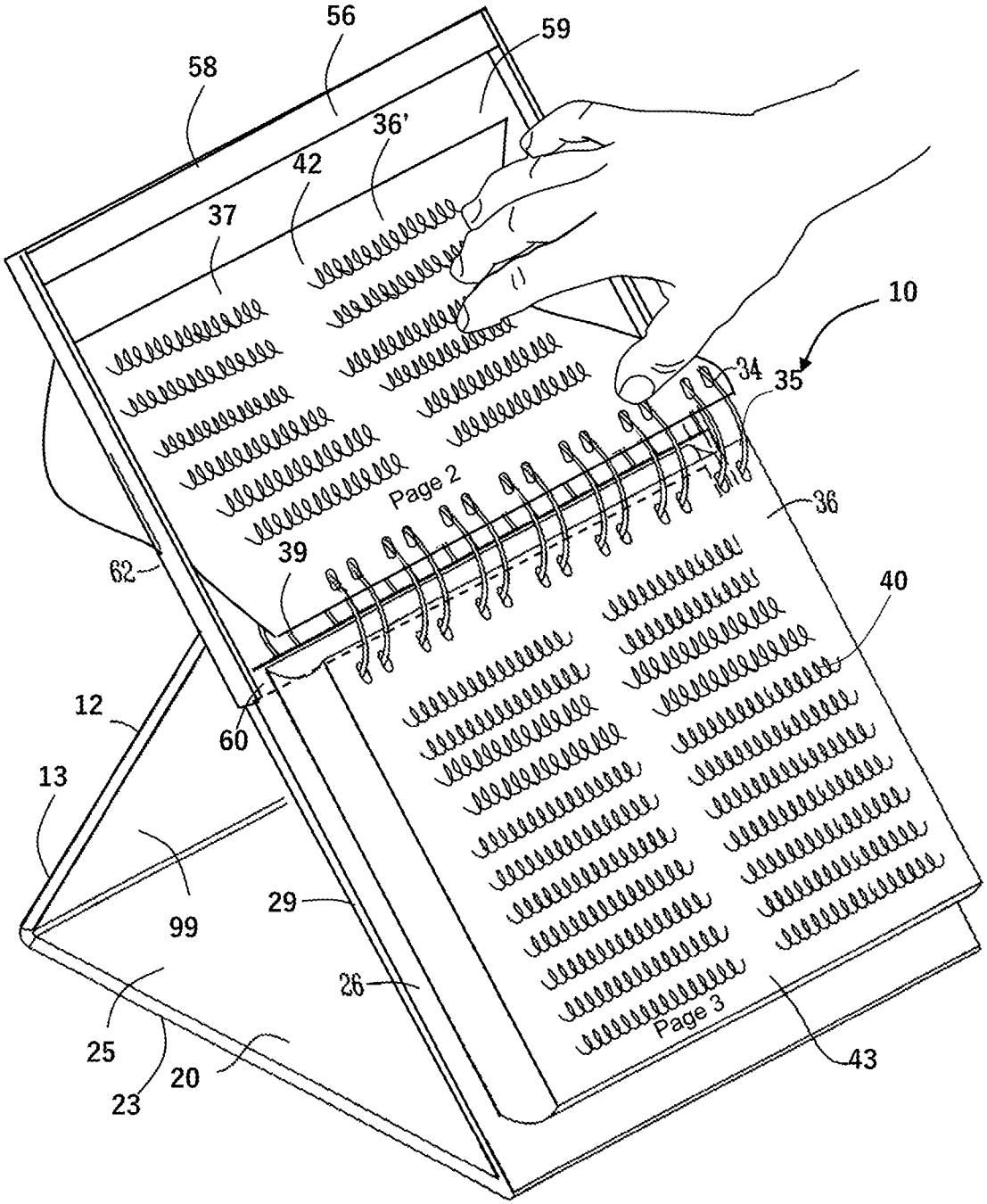
FIG. 9 is a perspective view of an exemplary self-supporting book in a propped position with a page being pushed through the cavity of the page holder.

As shown in FIG. 9, an exemplary self-supporting book 10 is in a propped position with a page 36' being pushed through the cavity 59 of the page holder 56. The extended end 37 of the page 36' slides from the top bar 58 and falls through the cavity 59 while the attached end of the page 39 rotates about the binding 34. The next page of the book can then be rotated up to be supported by the page holder, thereby exposing page four and page 5 of the book. A person may use their hand to simply push the page through the cavity. The page will flex and fall to rest on the front face 13 of the front cover. The back face 99 of the front cover is facing the third cover 26. The back cover has an exposed face 23, or face that is exposed when the book is in a closed position, and an inner face 25 that is opposing the exposed face.

Figure 10:
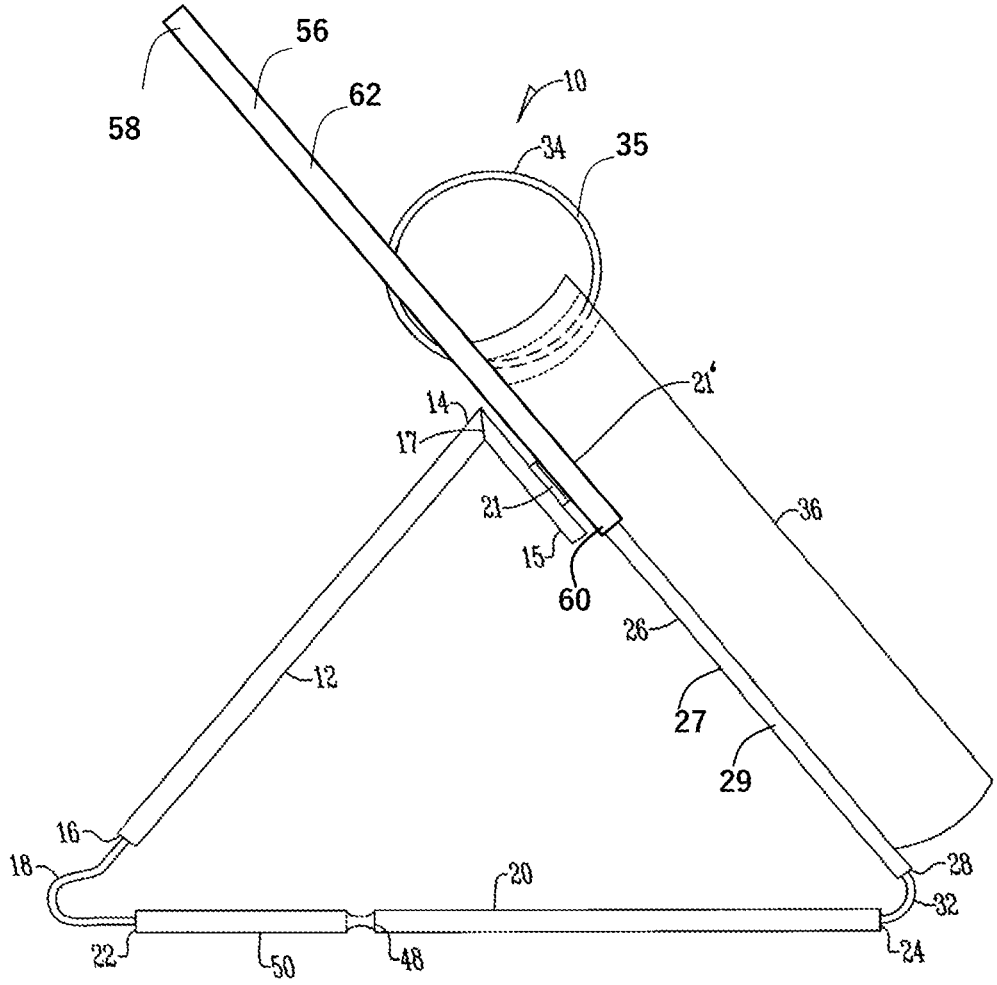
FIG. 10 is a left-side view of an exemplary self-supporting book in a propped position with a page holder slid up to a page supporting orientation.

As shown in FIG. 10, an exemplary self-supporting book 10 is in a propped position with a page holder 56 slid up to a page supporting orientation. The front cover 12 extension 15 is shown supporting the third cover 26. Hook-and-loop fasteners 21 on both the extension and the third cover keep the book secure in the propped-up position. The extension 15 or supporting strip may be rigid and extend substantially perpendicular from the plane of the front cover 12, or it may be flexible, wherein it can rotate about the fold line 17 along the first outer edge 14 of the front cover.

Figure 11:
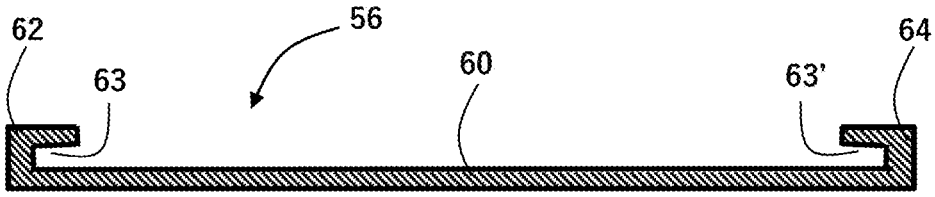
FIG. 11 is a bottom view of an exemplary page holder having channels that extend around the sides of the third cover and a bottom bar that extends between the left and right side members of the page holder.

As shown in FIG. 11, an exemplary page holder 56 has channels 63, 63' that are configured for extended around the sides of the third cover and a bottom bar 60 that extends between the left side member 62 and right side member 64 of the page holder. The bottom bar may extend along the back face 27 of the third cover 26, as shown in FIG. 10.

Figure 12:
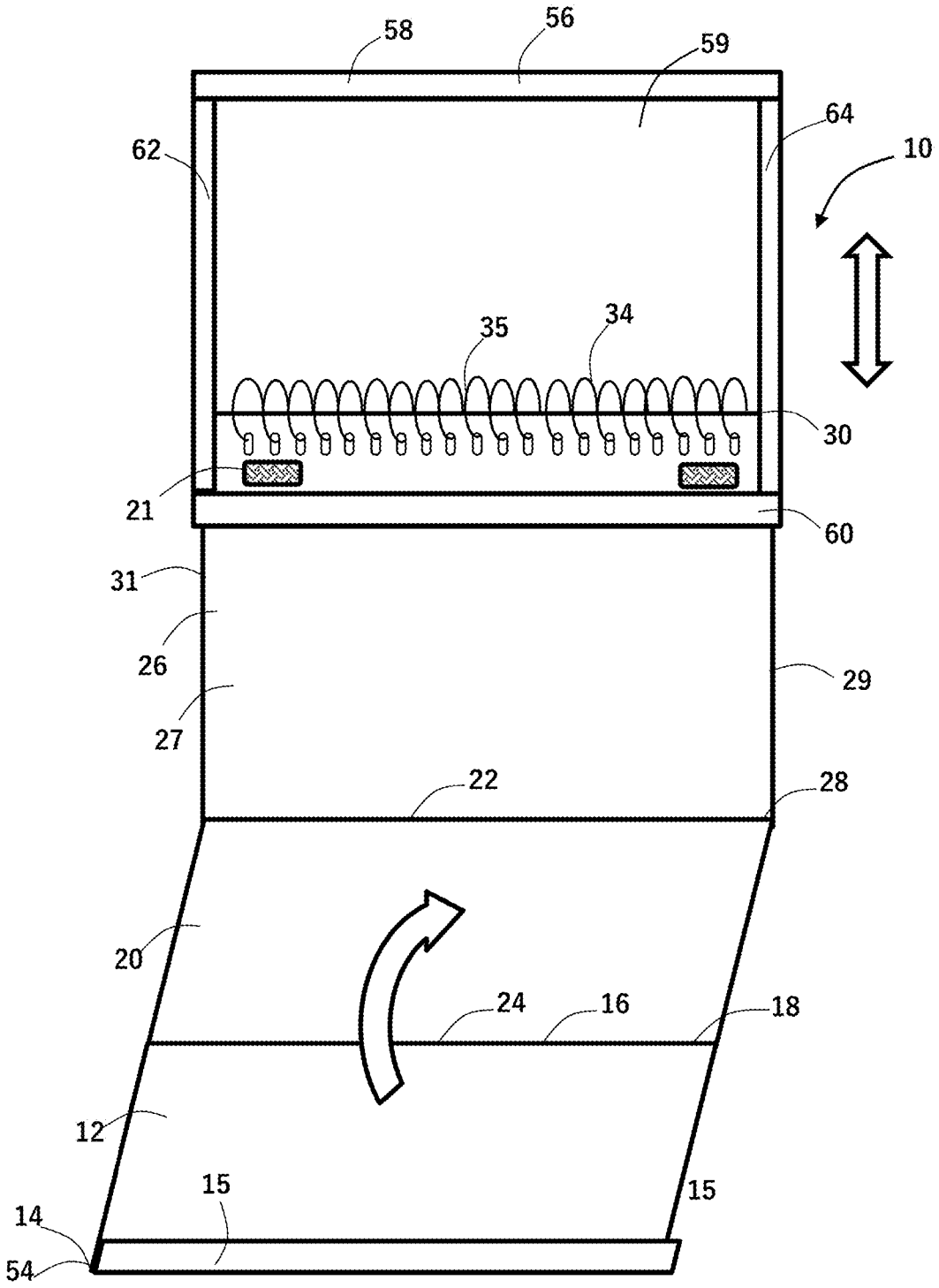
FIG. 12 is a back view of a self-supporting book with the third cover in an upright position and the front and back covers extend out from the third cover and the page holder slid up to a page supporting orientation.

As shown in FIG. 12, an exemplary self-supporting book 10 book is configured with the third cover 26 in an upright position and the front cover 12 and back cover 20 extend out from the third cover. The page holder 56 is slid up to a page supporting orientation and hook-and-loop fasteners 21 are configured on the back face 27 of the third cover to couple with hook-and-loop fasteners on the extension 15 of the front cover 12. The front cover 12 is configured to fold up along the spine 18 configured between the first front cover and second back cover. The extension is configured to rest against the back face 27 of the third cover 26 with the hook-and-loop fasteners coupled together. The bottom bar 60 of the page holder 56 extends across the back face 27 of the third cover 26.

Figure 4:
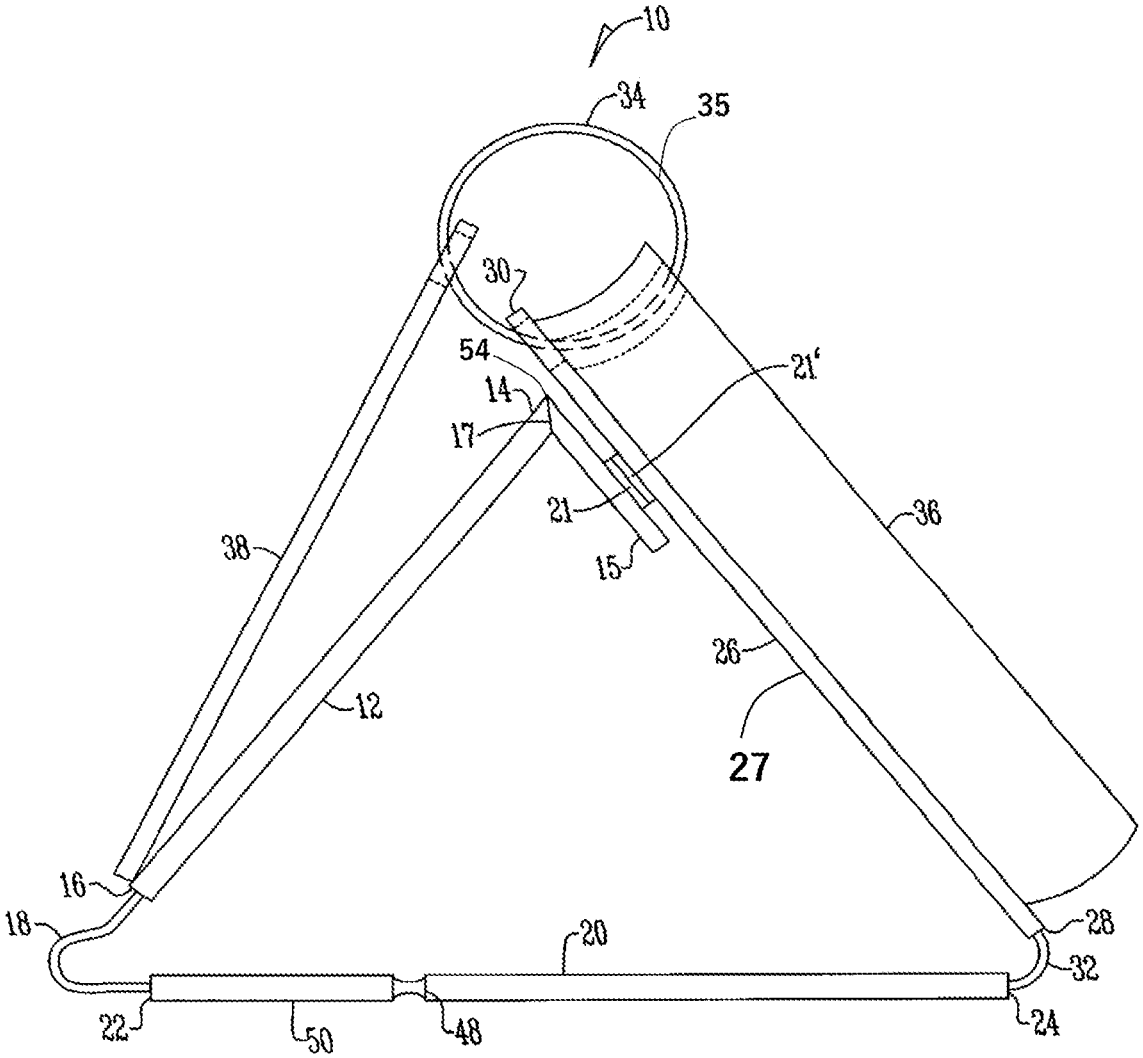
FIG. 4 is an elevational view of an exemplary self-supporting book in a propped position.
Figure 13:
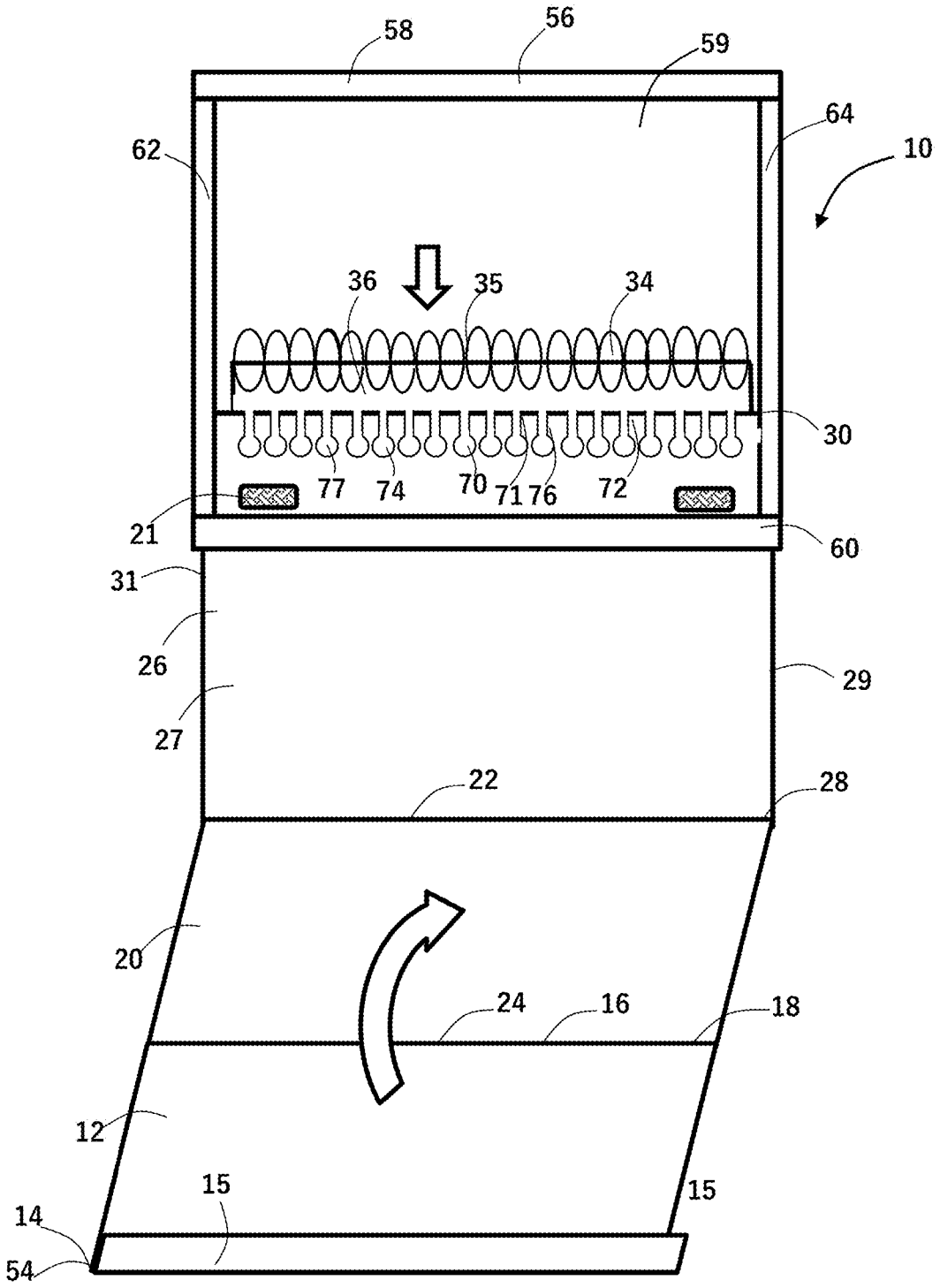
FIG. 13 is a back view of a self-supporting book with the third cover in an upright position and a binder and a plurality of pages detached from the binding retainer in the third cover.
Figure 14:
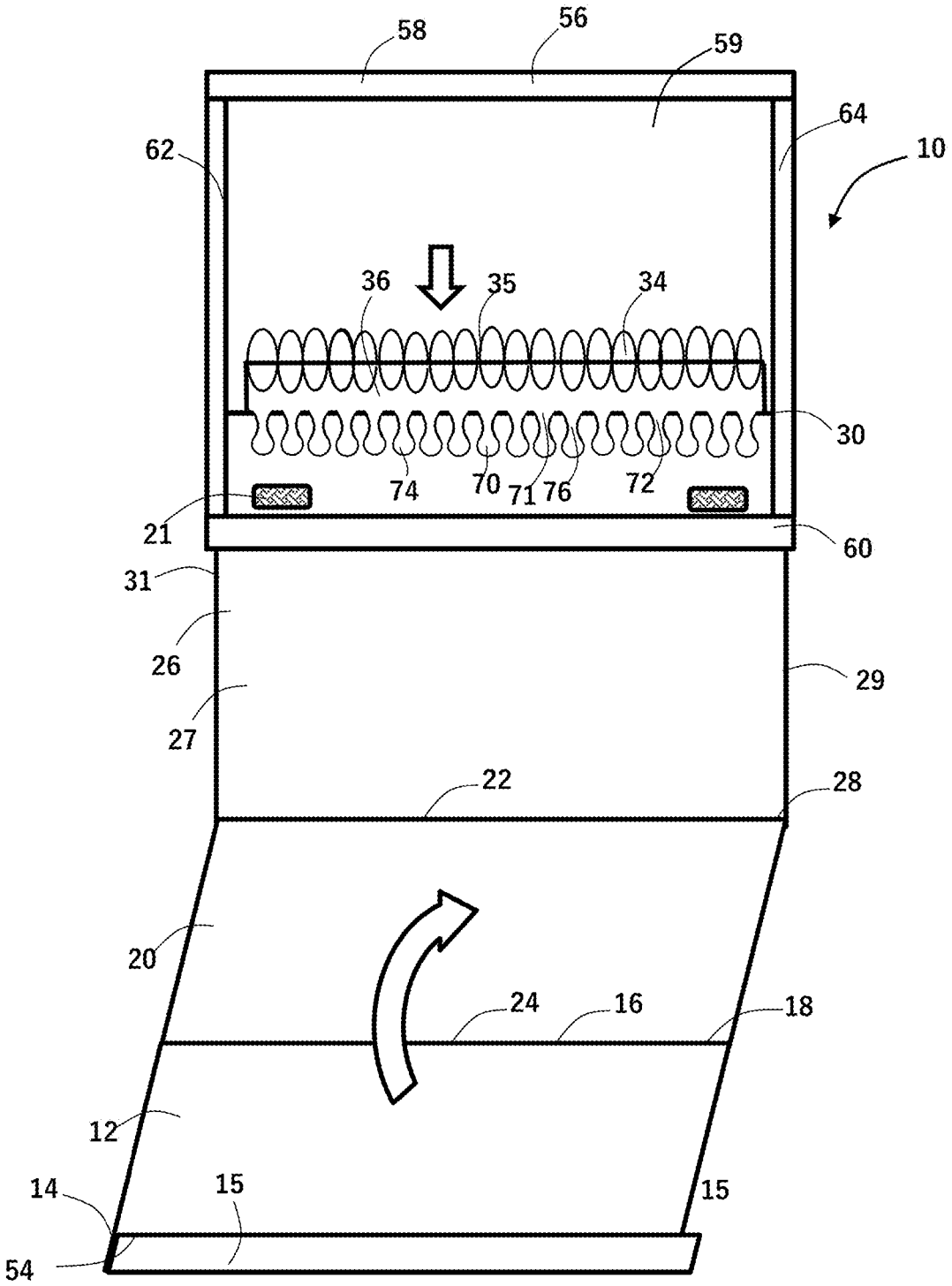
FIG. 14 is a back view of a self-supporting book with the third cover in an upright position and a binder and a plurality of pages detached from the binding retainer in the third cover.

With reference to FIGS. 4 to 10 and 12 to 14, the binding 34 and the plurality of pages 36 may be attached to the third cover 26 or detachably attachable to the third cover. In one embodiment, the binding comprises a plurality of rings 35 that extend through the pages of the book and also extend through the third cover, proximal to the outer edge 30 of the third cover. In another embodiment, a binding and plurality of pages are detachably attachable to the third cover, wherein the binding is coupled to the outer edge 30 of the third cover. The outer edge of the third cover may comprise a binding retainer 70, such as a plurality of slots or grooves for receiving the plurality of rings 35 of the binding 34 as shown in FIG. 13. The binding 34 and plurality of pages 36 may be placed such that the rings slide into the slots of the binding retainer 70 to detachably attach the binding and pages to the third cover. In this way, any number of books may be detachably attached to create a self-supporting book. A binding is described as comprising a plurality of rings and these rings may all be coupled such as a spiraling ring. A binding retainer 70 may also be a detachably attachable to the third cover, such as an adapter that has a groove or channel for sliding down over the outer edge of the third cover. The third cover or the binding retainer may comprise slots or apertures for attaching a binding thereto. As shown in FIG. 13, the slots 72 or grooves of the binding retainer 70 may be more narrow than the retainer portion 74 that is a circular aperture for receiving the rings, a keyway aperture 77. As shown in FIG. 14, a binding retainer 70 may also have a slot 72 having a narrow portion from the opening 71 of the slot to the retainer portion 74 for retaining a 35. The narrow portion 76 may be smaller in dimension than the opening and the retainer portion, as shown. Any type of mechanical binding can be used, such as Wire-O, spiral, comb, rings, or the like. As shown in FIG. 4, the third cover 26 has apertures that the rings 35 extend therethrough.

As used herein, the extension from the front cover extends substantially perpendicularly to the front cover when the angle between the plane of the front cover and the extension is between about 75 and 105 degrees.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A self-supporting book comprising:

a) a first cover that is a front cover comprising;
  i) a front face;
  ii) a back face;
  iii) a first outer edge; and
  iv) a first inner edge;

b) a second cover that is a back cover attached to the front cover and comprising:
  i) an exposed face that is exposed when the self-supporting book is in a closed position;
  ii) an inner face;
  iii) an inner edge; and
  iv) an outer edge;

wherein the inner edge of the back cover is rotatably attached to the first inner edge of the front cover;

c) a plurality of pages coupled to a binding wherein each of said plurality of pages has an attached end and an extended end;

wherein the binding comprises a plurality of rings that extend through a plurality of apertures in the plurality of pages;

d) a third cover attached to the back cover and comprising:
  v) a back face;
  vi) an inner edge;
  vii) an outer edge;
  viii) a left side edge;
  ix) a right side edge; and
  x) a binding retainer for detachably attaching the binding to the third cover; said binding retainer comprising:
    a plurality of slots;
    a retainer portion;

wherein the inner edge of the third cover is rotatably attached to the outer edge of the back cover;

wherein the plurality of rings of the binding are detachably attached to the third cover by insertion of said plurality of rings through the plurality of slots and into the retainer portion;

e) a page holder comprising:
  xi) a left side member;
  xii) a right side member;
  xiii) a top bar;
  xiv) a cavity between the left and right side members and between the top bar and the binding;

wherein the self-supporting book is configured to be self-supporting with the back cover extending from the third cover, and the front cover rotated to engage the first outer edge with the back face of the third cover;

wherein the page holder is slidably engaged with the third cover and configured to slide up along the third cover and extend from the outer edge of the third cover in a page support configuration to provide a support for one of said plurality of pages;

wherein a page supported by the page holder in said page support configuration can be pushed through the cavity of the page holder; and wherein the binding and plurality of pages are detachably attachable to the third cover.

2. The self-supporting book of claim 1, wherein the page holder further comprises a bottom bar and wherein said bottom bar of the page holder extends along the back face of the third cover.

3. The self-supporting book of claim 1, wherein the page holder comprises channels in the left side member and right side member that engage with the left side edge and right-side edge of the third cover, respectively.

4. The self-supporting book of claim 1, wherein the front cover further comprises an extension that extends from the first outer edge of the front cover, and wherein said extension comprises an extension hook and loop fastener portion, and wherein the back face of the third cover comprises a hook-and-loop fastener portion that is configured to engage with the extension hook-and-loop fastener portion, to support the self-supporting book in a propped-up configuration.

5. The self-supporting book of claim 4, wherein the extension extends downward from the front cover.

6. The self-supporting book of claim 1, wherein the front cover further comprises a magnet material configured proximal to the first outer edge of the front cover, and wherein the back face of the third cover comprises a magnetic material that is configured to engage with the magnetic material configured on the front cover to support the self-supporting book in a propped-up configuration.

7. The self-supporting book of claim 6, wherein the front cover further comprises an extension that extends from the first outer edge, and wherein the extension comprises said magnetic material configured on the front cover.

8. The self-supporting book of claim 7, wherein the extension extends downward from the front cover.

9. The self-supporting book of claim 6, wherein at least one of the magnetic material configured on back face of the third cover and a magnetic material configured on the extension is a magnet.

10. The self-supporting book of claim 9, wherein the magnetic material configured on the back face of the third cover and the magnetic material configured on the extension are magnets.

11. The self-supporting book of claim 1, wherein the plurality of slots extend to the retainer portion and are smaller in dimension than said retainer portion.

12. The self-supporting book of claim 1, wherein the binding retainer is detachably attachable to the third cover.

13. A self-supporting book comprising:

a) a first cover that is a front cover comprising;
  i) a front face;
  ii) a back face;
  iii) a first outer edge; and
  iv) a first inner edge;
  v) an extension that extends from the first outer edge;

wherein the extension comprises a magnetic material; and b) a second cover that is a back cover attached to the front cover and comprising:

i) an exposed face that is exposed when the self-supporting book is in a closed position;

ii) an inner face;

iii) an inner edge; and iv) an outer edge;

wherein the inner edge of the back cover is rotatably attached to the first inner edge of the front cover;

c) a third cover attached to the back cover and comprising:

i) a back face;

ii) an inner edge;

iii) an outer edge;

iv) a left side edge; and v) a right side edge;

wherein the inner edge of the of the third cover is rotatably attached to the outer edge of the back cover;

wherein the self-supporting book is configured to be self-supporting with the back cover extending from the third cover, and the front cover rotated to engage the first outer edge with the back face of the third cover;

d) a plurality of pages coupled to a binding wherein each of said plurality of pages has an attached end and an extended end;

e) a binding comprising a plurality of rings that extend through a plurality of apertures in the plurality of pages;

f) a binding retainer configured along the outer edge of the third cover and comprising:

i) a plurality of slots;

ii) a retainer portion;

wherein the plurality of slots extend to the retainer portion and wherein the plurality of slots are smaller in dimension than said retainer portion;

wherein the binding is configured for detachably attachment to the binding retainer with the plurality of rings inserted through the plurality of slots and retained in the retainer portion of the binding retainer; and wherein the self-supporting book is configured to be self-supporting with the back cover extending from the third cover and the front cover rotated to engage the extension with the back face of the third cover; and wherein the binding and plurality of pages are detachably attachable to the third cover.

14. The self-supporting book of claim 13, wherein the back face of the third cover comprises a magnetic material that is configured to engage with a magnetic material configured on the first cover to support the self-supporting book in a propped-up configuration.

15. The self-supporting book of claim 14, wherein at least one of the magnetic material on back face of the third cover and the magnetic material on the extension is a magnet.

16. The self-supporting book of claim 14, wherein both the magnetic material on the back face of the third cover and the magnetic material on the extension is a magnet.

17. The self-supporting book of claim 13, wherein the binding retainer is detachably attachable to the third cover.

* * * * *